United States Patent [19]

Grobman et al.

[11] Patent Number: 4,622,095

[45] Date of Patent: Nov. 11, 1986

[54] LASER STIMULATED HALOGEN GAS ETCHING OF METAL SUBSTRATES

[75] Inventors: Warren D. Grobman, Yorktown Heights; Fahfu Ho, Wappingers Falls; Jerry E. Hurst, Jr., Croton-on-Hudson; John J. Ritsko, Mt. Kisco; Yaffa Tomkiewicz, Scarsdale, all of N.Y.

[73] Assignee: IBM Corporation, Armonk, N.Y.

[21] Appl. No.: 789,235

[22] Filed: Oct. 18, 1985

[51] Int. Cl.[4] ..... C23F 1/02; B44C 1/22; C03C 15/00; C03C 25/06

[52] U.S. Cl. ..... 156/635; 156/643; 156/646; 156/656; 156/664; 156/666; 219/121 LJ; 219/121 LM; 427/53.1

[58] Field of Search ..... 156/635, 643, 646, 656, 156/659.1, 664, 666; 252/79.1; 427/53.1; 121/121 LJ, 121 LH, 121 FS, 121 LM

[56] References Cited

U.S. PATENT DOCUMENTS

| | | | |
|---|---|---|---|
| 3,364,087 | 1/1968 | Solom et al. | 156/4 |
| 4,260,649 | 4/1981 | Denison et al. | 427/53.1 |
| 4,331,504 | 5/1982 | Chuang et al. | 156/635 |
| 4,335,295 | 6/1982 | Fowler | 219/121 |
| 4,398,993 | 8/1983 | Hume et al. | 156/643 |
| 4,478,677 | 10/1984 | Chen et al. | 156/635 |
| 4,490,210 | 12/1984 | Chen et al. | 156/643 |
| 4,490,211 | 12/1984 | Chen et al. | 156/643 |

OTHER PUBLICATIONS

IBM Technical Disclosure Bulletins (ITDB) ITDB, vol. 24, #11A, Apr. 1982, p. 5376 (Bhattacharyya).
ITDB, vol. 25, #1, Jun. 1982, p. 23 (Acosta et al).
ITDB, vol. 25, #1, Jun. 1982, p. 32 (Hodgson et al).
ITDB, vol. 26, #5, Oct. 1983, p. 2436 (Anderson et al).
ITDB, vol. 26, #10A, Mar. 1984, p. 5015 (Creedon).
ITDB, vol. 26, #10B, Mar. 1984, p. 5540 (Hendricks).
ITDB, vol. 27, #3, Aug. 1984, p. 1490 (Chen).

*Primary Examiner*—William A. Powell
*Attorney, Agent, or Firm*—Perman & Green

[57] ABSTRACT

A method of radiation induced dry etching of a metallized (e.g. copper) substrate is disclosed wherein the substrate is pattern-wise exposed to a beam of laser radiation in a halogen gas atmosphere which is reactive with the substrate to form a metal halide salt reaction product to accelerate the formation of the metal halide salt without its substantial removal from the substrate. The metal halide salt is removed from the substrate by contact of the substrate with a solvent for the metal halide salt.

14 Claims, No Drawings

LASER STIMULATED HALOGEN GAS ETCHING OF METAL SUBSTRATES

BACKGROUND OF THE INVENTION

1. Field of the Invention

This invention concerns a method of radiation induced dry etching of a metal substrate. More particularly, the invention concerns the use of a halogen gas which reacts with the metal forming a solid reaction product which is capable of being removed when irradiated with a beam of radiation generated by an excimer laser.

2. The Prior Art

The trend in electronics today is towards systems of ever increasing component density. Increased component density permits designers to achieve greater speed and complexity of system performance while maintaining system size at a minimum. Additionally, increased component density enables manufacturers to lower production costs owing to the economies that can be realized using integrated circuit processing.

The desire for increased component density has given rise to very large scale integrated circuit (VLSI). In such circuits, designers pack large numbers of electrical components onto individual integrated circuit chips. Subsequently, these chips are ganged on a substrate to form larger circuits and functional blocks of a system.

To facilitate the mounting of the high density circuit chips, designers have developed the so-called multilayer ceramic (MLC) substrate. The MLC substrate is well known and has been described in such articles as "A Fabrication Technique for Multilayer Ceramic Modules" by H. D. Kaiser et al, appearing in Solid-State Technology, May, 1972, pp. 35–40.

An example of a semiconductor module including a multilayer ceramic substrate is given in U.S. Pat. No. 4,245,273 issued to Feinberg et al and assigned to the assignee of this application.

MLC manufacturers have found that substrate performance, particularly, the maximum circuit speed the substrate will sustain, can be increased by reducing the length of the thick film metal wiring built into the substrate to interconnect the chips. Designers have proposed to reduce interconnection wiring by replacing at least some of the MLC thick film circuits with multilayer thin film circuits. Particularly, designers have proposed to use thin film circuits at the MLC chip mounting surface. The thin film circuits are formed at the MLC chip mount surface as multiple layers of thin film metal separated by layers of insulation such as a polyimide or other polymeric organic material. The multiple metal layers are interconnected by vertical metallization which extends through holes commonly referred to as vias that are arranged in a predetermined pattern.

Because it is possible to make a line of smaller dimension, using thin film technology as compared with thick film technology, it is possible to fit more circuits in a substrate plane. Where higher circuit density per plane is achieved, fewer planes are required and accordingly the circuit wiring length interconnecting the multiple planes can be reduced. By shortening the plane interconnection metallization less circuit inductance and parasitic capacitance is present permitting the higher frequency performance. This technique for increasing frequency capability has come to be referred to as Thin Film Redistribution (TFR). An illustration of an MLC including a TFR structure is provided in U.S. Pat. No. 4,221,047 issued to Narken et al and assigned to IBM Corporation, the assignee of this invention.

While the size of TFR multilevel metallization structure is smaller than that of thick film, it is not as small as thin film metallization structure used on the chips. Because the TFR current is a combination of the currents supplied by the multiple chips, it is substantially greater than the chip current. The TFR metallization must therefore be of larger physical size than that of the chip to maintain current densities and associated heating at acceptable levels. Additionally, the dielectric separating the TFR metal layers is also thicker and of different composition. As taught in the above mentioned U.S. patents, copper is the metal most widely used for forming the metallization patterns. It is therefore obvious that copper etching is an essential process in both Thin Film Redistribution (TFR) and Metallized Ceramic Polyimide (MCP) technology, and more generally for various packaging applications where there is a need to define wiring patterns in thick copper films.

Unfortunately, because TFR metallization structures are larger than those of an integrated circuit chip and because the materials are somewhat different, the thin film process techniques conventionally used for an integrated circuit chip metallization fabrication such as the lift-off etching technique and dry etching (plasma or reactive ion etching) cannot be easily used in making TFR structures. The lift-off technique is complex and difficult to define in thick films. Dry etching needs complex equipment and process steps involving inorganic masks such as MgO and $SiO_2$. Furthermore, dry etching is not accurately repeatable and controllable particularly in large batch processing.

U.S. Pat. No. 4,490,211 issued to Chen et al and assigned to IBM Corporation, the assignee of this application, the disclosure of which is herein incorporated by reference, discloses a process for dry etching the copper metallization layers of MCL substrates having TFR multilayer copper metallization layers wherein the metallized copper substrate is mounted in a reaction chamber in which a vacuum of predetermined pressure is established. A halogen gas, such as chlorine is introduced into the chamber. The gas spontaneously reacts with the copper substrate and forms a solid reaction product (CuCl) thereon by partial consumption of the copper surface. The CuCl surface is selectively irradiated with a patterned beam of radiation from a pulsed excimer laser operating at a wavelength suitable for absorption by the CuCl. Whenever the excimer laser strikes, due to heating caused by absorption of the radation, the thin layer of CuCl is vaporized exposing a fresh layer of copper. A new layer of CuCl is formed on the freshly exposed metal, as before, by reacting the metal with additional quantities of the halogen has. This new layer of CuCl, in turn, is removed by irradiating with a pulse of laser radiation. In this manner, the metal is etched.

In areas of the copper metallization which are not irradiated with radiation from the excimer laser, the CuCl reaction product remains intact until removal, at the termination of the laser etch process, by rinsing in a diluted chemical solution such as dilute ammonium hydroxide solution. Due to the selective nature of etching of the copper metal, patterning thereof is possible using the excimer laser radiation.

One drawback to the laser induced chemical etching process disclosed in U.S. Pat. No. 4,490,211 is that the etching process is relatively slow and consumes a considerable amount of laser energy.

SUMMARY OF THE INVENTION

In accordance with the practice of the present invention, there is provided an improved process for laser etching of metallized substrates which is accomplished with greater speed and reduced energy consumption, wherein the metallized substrate to be etched is placed in a reaction chamber containing a halogen gas which reacts with the metallized layer to form a metal halide salt reaction product on the substrate. The metallized substrate is exposed to a patterned beam of laser radiation projected onto the substrate at a wavelength suitable for absorption by the metal halide salt reaction product to accelerate the formation of the reaction product. The reaction product accumulated on the substrate is removed from the substrate by contact of the substrate with a solvent for the metal halide reaction product.

The speed of the laser etching process of the present invention can be further enhanced by the employment of elevated temperatures and pressures durng the laser etching step.

DETAILED DISCLOSURE OF THE INVENTION

In practicing the process of the present invention, an etching system of the type disclosed in U.S. Pat. No. 4,490,211 is utilized for effecting the etching of metallized substrates such as copper with a rare gas pulsed excimer laser which is capable of emitting a characteristic wavelength which matches the halide salt reaction product. To effect the etching, the metallized substrate that is to be etched is mounted in the reaction chamber of the etching system of the type disclosed in U.S. Pat. No. 4,490,211. A suitable metallized substrate can be copper, chromium, titanium, molybdenum, aluminum and stainless steel. The etching process of the present invention is particularly suitable for etching MCL substrates having TFR multilevel metallization which utilize a sandwich layer of chromium-copper-chromium formed on a silicon or ceramic substrate. The chromium layers are thin, typically about 200 to about 1200 Å, and the copper thickness is about 2 to about 10 microns. The etching process conveniently lends itself to etching the chromium-copper-chromium sandwich layer in the same reaction chamber using the same reactant gas for etching both metals. For example, when a halogen gas such as chlorine is utilized, it will spontaneously react with chromium forming a chromium chloride reaction product which can be driven off by irradiating with an excimer laser pulse of the same wavelength used for driving off the copper chloride.

After mounting the metallized substrate in the reaction chamber, the chamber is then evacuated to a pressure of less than $10^{-5}$ to remove any gaseous components therein and subsequently halogen gas is introduced until a pressure of between 0.001 and 100 torr and preferably about 0.4 to about 1.0 torr is attained. The halogen gas introduced into the reaction chamber will spontaneously react with the metallized layer to form a thin surface layer of the halide salt reaction product. The reaction between the metallized layer and the halogen gas proceeds slowly. For example in using chlorine gas pressurized to 0.4 torr, at room temperature, electron beam evaporated copper films of 5 micron thickness are converted to cuprous chloride in 25 to 30 minutes. The copper chloride is formed by diffusion of chlorine through the CuCl to react with the underlying copper.

As will hereinafter be illustrated, the reaction between the halogen gas and the metallized substrate has been found to be greatly accelerated by using halogen gas pressures in the order of about 0.4 to about 10.0 torr at temperatures in the order of about 35° to 140° C. as the reaction generally increases with increasing pressure. Thus, it is a preferred practice of the present invention that the process of the present invention utilize a halogen gas pressure in the order of about 0.1 to about 100 torr and most preferably a halogen gas pressure of about 0.4 to about 10 torr.

It has also been found that the reaction between the halogen gas and the metallized substrate at a pressure can also be accelerated by the use of elevated temperatures i.e. in the order of about 35° to about 140° C. as the reactive diffusion reaction utilized in the present invention is a thermally activated process. Prior art practice with respect to the etching of metals with lasers in halogen atmospheres is conventionally conducted at room temperature based on the conventional belief that elevated temperatures reduce the etch rate or disadvantageously degrade the final etched structure. As will hereinafter be illustrated, the etch rate can be significantly accelerated in accordance with the process of the present invention when a temperature of about 35° to about 140° C. is employed. At temperatures in excess of about 140° C., the etch rate is found to decline. With respect to the halogen gas utilized in the practice of the present invention, bromine is the preferred gas. As will hereinafter be illustrated, the use of bromine as the reactive gas in the process of the present invention significantly improves the etch rate induced by the laser radiation over that achieved with other halogen or halogen containing gases.

To effect pattern-wise etching of the metallized substrate, a patterned beam of laser radiation is projected onto the substrate through a patterned mask at a wavelength suitable for absorption by the metal halide salt. The laser is desirably a pulsed excimer laser and the wavelengths employed are in the ultraviolet range and are preferably below 370 nanometers (nm). Excimer lasers that can advantageously be employed in the practice of the present invention include a $F_2$ laser operating at a wavelength of 157 nm, an ArF laser at 193 nm, a KrCl laser at 249 nm, a KrF laser at 248 nm, a XeCl at 308 nm, and a XeF laser at 351 nm.

During the etching step of the process of the present invention, the pulse of excimer laser radiation strikes the metal halide salt reaction product formed on the metallized substrate in a pattern dictated by the projection mask. Upon contact with the laser, the metal halide salt will, due to absorption of the radiation, undergo thermal and electronic excitation, thereby accelerating the conversion of the metallized substrate to the metal halide reaction product. To inhibit the reaction between the halogen gas and the metallized substrate in the regions of the substrate which are not subject to pattern-wise irradiation, the substrate is passivated by heating in air at about 100° to about 150° C. from about 10 to about 30 minutes prior to exposure of the substrate to the halogen gas to form on the substrate a passivating film of metal oxide. For example, when copper films are heated in air at about 125° C. for about 25 minutes, a thin (less than 100 Å) copper oxide film forms on the copper surface. When patterned laser etching of the passivated copper surface is performed, the initial pulses of laser radiation destroy the passivating film and expose the underlying copper surface to reaction with the halogen gas in the reaction chamber. Thus, it has been determined that the copper oxide film can be penetrated and destroyed within 10 pulses of 308 nm radiation in an atmosphere of chlorine gas pressurized at 0.4 torr.

The pattern-wise laser exposure of the metallized substrate causes the metal halide salt reaction product to accumulate in the radiation exposed regions of the substrate without being entirely ablated by subsequent laser pulses. As the radiation exposure continues, the accumulation of reaction product builds to a level whereby the laser radiation directed to the substrate is substantially totally absorbed by the film of accumulated reaction product. The laser radiation stimulates the growth of the metal halide to the point that a 5 micron thick copper film is entirely converted to CuCl in less than 2 minutes and further reaction of the substrate with the halogen gas, therefore stops. The film of reaction product accumulated in the patterned region thereby acts as an etch-stop for the process and the need for an etch-stop layer to prevent overetching of the metallurgy into the underlying insulation, e.g., polyimide, layer is thereby avoided.

After the laser radiation etching has proceeded to the point whereby the radiation is being totally absorbed by the accumulated reaction product film, and the copper or other metallized film has been completely converted to the metal halide further radiation exposure will only cause volatilization of the exposed reaction product film.

At this stage in the practice of the prior art, the pulsed laser radiation of the substrate is continued and is used to volatilize the accumulated metal halide reaction product, and is continued until the entire metal is etched through forming a desired conductor pattern, whereupon the metallized substrate is removed from the reaction chamber and the substrate cleaned by rinsing with a dilute alkaline solution, e.g. $NH_4OH$ and dionized water. In the prior art practice the number of excimer laser pulses required to achieve full etching of a 5 micron thick copper film is in the order of 300 or more pulses. In accordance with the present invention, it has been discovered that when using metallized substrates such as copper, radiation wavelengths below 370 nm are absorbed within 0.2 nm of the metal halide salt, e.g. cuprous halide surface. After the metallized substrate is pattern-wise exposed to the pulsed excimer laser radiation, within a limited number of laser pulses, e.g. 106–120 laser pulses, substantially complete conversion of the metallized substrate to metal halide salt occurs in the exposed patterned area. By following the practice of the present invention, instead of continuing the pulsed excimer laser radiation to volatilize and remove the metal halide salt that accumulates on the metal substrate, the laser radiation is discontinued and the substrate bearing the unvolatilized, accumulated, metal halide salt film is removed from the reaction chamber and immersed in a solvent for the film such as a dilute alkaline solution such as dilute $NH_4OH$, whereby the accumulated metal halide salt film is dissolved and removed from the substrate. As will hereinafter be illustrated, the etching of 5.0 micron thick copper film may be accomplished with about 100 excimer laser pulses whereas formerly by using the laser etching processes of the prior art at least about 300 laser pulses were required thereby resulting in a substantial savings in laser energy costs as well as substantial increase in the production rate of the laser system. An ancillary advantage of the process of the present invention is that since all the laser energy is absorbed by the metal halide salt, the laser never etches through the salt layer, and, therefore, provision for a laser etch stop is eliminated, the substrate never being directly exposed to the halogen gas.

The process of the invention is further illustrated by, but is not intended to be limited to, the following examples.

EXAMPLE I

In a series of runs, a series of silicon substrates having a 4.0 micron thick copper layer formed thereon were mounted in the reaction chamber of a pulsed excimer laser system. After establishing a low pressure of $10^{-3}$ torr to evacuate the chamber, chlorine gas was introduced into the chamber at a pressure of 0.4 torr.

To achieve selective etching of the copper, a pulsed beam of radiation from an XeCl laser operating at a wavelength of 308 nm at a fluence of 0.2 J/cm$^2$ and a pulse rate of 1 Hz was passed through a patterned mask onto the copper layer in the chamber.

The number of laser pulses used to achieve etching was varied from about 18 to 300. After each run, the height of the accumulated CuCl reaction product deposited on the copper layer was measured. The substrate was then immersed in a dilute $NH_4OH$ solution for about one minute and then rinsed with deionized water. The thickness of the remaining copper layer on the rinsed substrate was also measured. The results are recorded in Table I below.

TABLE I

| Run No. | No. of Laser Impulses | Height of CuCl Reaction Product (microns) | Thickness of Etched Copper Layer |
|---|---|---|---|
| 1. | 18.0 | 0 | 4.0 |
| 2. | 37.0 | 7.1 | 2.0 |
| 3. | 62.0 | 10.5 | 0.5 |
| 4. | 100.0 | 10.0 | 0.0 |
| 5. | 137.0 | 7.5 | 0.0 |
| 6. | 181.0 | 5.5 | 0.0 |
| 7. | 222.0 | 3.9 | 0.0 |
| 8. | 300.0 | 0.5 | 0.0 |

The data in Table I show that after about 100 pulses, the copper has been converted entirely to CuCl whereby removal of the copper chloride reaction product can be effected by the less costly, a more expedient procedure of washing out the copper chloride layer in a dilute $NH_4OH$ solution as opposed to volatilization of the copper chloride layer by the pulsed laser.

EXAMPLE 2

In a series of runs, silicon substrates having deposited thereon a TFR type multilevel metallization comprised of a chromium (300 Å thickness)/Copper (5 micron thickness)/Chromium (1000 Å thickness) sandwich were mounted in the reaction chamber of the pulsed excimer laser system used in Example 1. After establishing a low pressure of $10^{-3}$ torr to evacuate the chamber, chlorine gas was introduced into the chamber at a pressure of 0.4 torr, the temperature of the substrate was varied from 19°–159° C.

To achieve selective etching of the TFR metallization, a pulsed beam of radiation from an XeCl laser operating at a wavelength of 308 nm at a fluence at 0.5 J/cm$^2$ and a pulse rate of 40 Hz was passed through a patterned mask onto the TFR metallization. The etch rate of the metallization over the temperature range employed is recorded in Table II below.

TABLE II

| Temperature °C. | Etch Rate (Å/Sec) |
|---|---|
| 19 | 1150 |
| 39 | 1300 |
| 59 | 1530 |
| 79 | 1550 |
| 99 | 1470 |
| 119 | 1330 |
| 139 | 1200 |
| 159 | 1040 |

The data recorded in Table I show that the etch rate using a pulsed excimer laser is increased at temperatures above room temperature, reaches a peak and decreases thereafter.

EXAMPLE 3

The procedure of Example 2 was repeated with the exception that the chlorine gas pressure was varied from 0.1 to 1.0 torr. The fluence was approximately 0.55 J/cm$^2$ and the pulse rate 40 Hz. The results are recorded in Table III below.

TABLE III

| | Etch Rate (Å) At Pressure (Torr) | | | | |
|---|---|---|---|---|---|
| Temperature °C. | 0.1 | 0.2 | 0.4 | 0.7 | 1.0 |
| 19 | 450 | 850 | 1175 | 1375 | 1625 |
| 39 | 400 | 950 | 1675 | 1925 | 2075 |
| 59 | 650 | 1050 | 1775 | 2375 | 2750 |
| 79 | 375 | 750 | 1500 | 2100 | 2625 |
| 99 | 300 | 750 | 1550 | 2375 | 2900 |
| 119 | 300 | 750 | 1375 | 2100 | 2625 |

The data in Table III demonstrate that at temperatures above room temperature and chlorine gas pressures of about 0.4 torr or more, the etch rate increases with increasing pressure, and that the relative increase is greater at higher temperatures.

EXAMPLE 4

The procedure of Example 2 was repeated wherein a ceramic substrate having deposited thereon a TFR type metallization comprised of a chromium (1000 Å)/Copper (8 microns)/chromium (1000 Å) sandwich was completely etched in 10 seconds using 10.0 torr of chlorine at 140° C. with a fluence of 0.54 J/cm$^2$ and a pulse rate of 40 Hz.

By way of contrast when the procedure of Example 4 was repeated with the exception that the laser etching was conducted at room temperature, the etch time was 60 seconds.

EXAMPLE 5

In a series of runs, ceramic substrates having deposited thereon a TFR type metallization comprised of a chromium (1000 Å)/copper (8 um)/chromium (1000 Å) sandwich were mounted in a reaction chamber of a pulsed excimer laser system. After establishing a low pressure of $10^{-3}$ torr to evacuate the chamber, bromine gas was introduced into the chamber at a pressure of 0.4 torr. The temperature of the substrate was maintained at 19° C.

To achieve selective etching of the TFR metallization, a pulsed beam of radiation from an XeCl laser operating at a wavelength of 308 nm and a fluence which was varied from 0.25 to 0.50 J/cm$^2$ and a pulse rate of 5–40 Hz was passed through a patterned mask onto the TFR metallization. The etch rate of the metallization is recorded in Table IV below.

The procedure of Example 5 was repeated with the exception that chlorine gas was substituted for the bromine gas. The etch rate of the metallization with chlorine gas is recorded in Table V.

TABLE IV

| | Bromine Gas Etchant | | |
|---|---|---|---|
| Pulse Rate | Etch Rate Å/sec. | at Fluence (J/cm$^2$) of | |
| Hz | 0.25 | 0.50 | 1.0 |
| 5 | 80 | 270 | 1000 |
| 10 | 250 | 850 | 2000 |
| 20 | 400 | 1350 | 3600 |
| 40 | 600 | 2400 | 6600 |

TABLE V

| | Chlorine Gas Etchant | | |
|---|---|---|---|
| Pulse Rate | Etch Rate Å/Sec at Fluence (J/cm$^2$) of | | |
| Hz | 0.25 | 0.40 | 0.450* |
| 5 | 130 | 450 | 480 |
| 10 | 290 | 880 | 890 |
| 20 | 470 | 1200 | 1280 |
| 40 | 960 | 1650 | 1600 |

*at fluences above 0.45 J/cm$^2$ the etch rates in chlorine are constant.

The data recorded in Tables IV and V indicate that when bromine was used as the etching gas, the etch rate could be continually increased with increasing fluence over the range 0.25 to 1.0 J/cm$^2$ as the pulse rate was increased from 5 to 40 Hz to achieve extremely high etch rates e.g. 0.6 microns/sec., whereas the etch rate with chlorine gas reached a steady state at about 0.40 J/cm$^2$ to achieve a relatively low etch rate, e.g. 0.16 microns/sec. This is a particularly unexpected result given the similar chemical nature of the halogens.

As an alternative to the process described above a laser beam may be used to substantially completely etch through the metal, the etch rate being increased by the proper combination of high temperature and pressure (i.e., pressures of about 0.1 to about 10 torr and temperatures of about 35° C. to about 140° C.). When bromine gas is used here to react with the substrate to form the metal halide, superior results are obtained. If this alternative process is used, there is no need to contact the substrate with a solvent to remove any metal halide salt reaction product.

While specific components of the present system are defined above, many other variables may be introduced which may in any way affect, enhance, or otherwise improve the system of the present invention. These are intended to be included herein.

Although variations are shown in the present application, many modifications and ramifications will occur to those skilled in the art upon a reading of the present disclosure. These, too, are intended to be included herein.

Having thus described our invention, what we claim as new, and desire to secure by Letters Patent is:

1. A method of radiation induced dry etching of a metallized substrate comprising the steps of (a) mounting the substrate in a reaction chamber, (b) introducing into the chamber a halogen gas which is reactive with the substrate to form a metal halide salt reaction product, (c) projecting a patterned beam of laser radiation onto the substrate at a wave-length suitable for absorption by the metal halide to accelerate the reaction between the halogen gas and the substrate in the patterned areas without substantial removal of the reaction product which forms therein, and then (d) removing the metal halide reaction product from the substrate by contact of the substrate with a solvent for the metal halide salt reaction product.

2. The method of claim 1 wherein the halogen gas is chlorine.

3. The method of claim 1 wherein the halogen gas is bromine.

4. The method of claim 1 wherein the laser is a beam of pulsed excimer radiation.

5. The method of claim 4 wherein the excimer laser is operated at an ultraviolet wavelength of less than 380 nanometers.

6. The method of claim 5 wherein the excimer laser is an XeCl laser operated at 308 nanometers.

7. The method of claim 1 wherein the halogen gas is pressurized in the range of about 0.1 to about 10 torr.

8. The method of claim 1 wherein the substrate is heated to a temperature between about 35° C. and about 140° C.

9. The method of claim 1 wherein the substrate is heated in air between about 100° C. to about 150° C. to passivate the metallized substrate before exposure to the halogen gas.

10. A method of radiation induced dry etching of a metallized substrate comprising the steps of (a) mounting the substrate in a reaction chamber, (b) introducing, under high pressure, into the chamber a halogen gas which is reactive with the substrate, said substrate being heated, to form a metal halide salt reaction product, and (c) projecting a patterned beam of laser radiation onto the substrate to substantially completely remove the metal halide in the patterned areas.

11. The method of claim 10 wherein the halogen gas is bromine.

12. The method of claim 10 wherein the halogen gas is pressurized in the range of about 0.1 to about 10 torr.

13. The method of claim 10 wherein the substrate is heated to a temperature between about 35° C. and about 140° C.

14. The method of claim 10 wherein the substrate is heated in air between about 100° C. to about 150° C. to passivate the metallized substrate before exposure to the halogen gas.

* * * * *